United States Patent [19]

Kummer et al.

[11] Patent Number: 4,570,161

[45] Date of Patent: Feb. 11, 1986

[54] RASTER SCAN DIGITAL DISPLAY SYSTEM

[75] Inventors: David A. Kummer, Boca Raton; Jesus A. Saenz, Coral Springs; Stephen W. Trynosky, Boca Raton, all of Fla.

[73] Assignee: International Business Machines Corporation, Armonk, N.Y.

[21] Appl. No.: 523,915

[22] Filed: Aug. 16, 1983

[51] Int. Cl.[4] ..... G09G 1/02; G09G 1/14

[52] U.S. Cl. ..... 340/799; 340/734; 340/750; 340/709

[58] Field of Search ..... 340/703, 709, 734, 750, 340/799

[56] References Cited

U.S. PATENT DOCUMENTS

| | | | |
|---|---|---|---|
| 4,143,360 | 3/1979 | Bernhart et al. | 340/799 X |
| 4,189,728 | 2/1980 | Stubben | 340/799 X |
| 4,196,430 | 4/1980 | Denko | 340/799 X |
| 4,197,590 | 4/1980 | Sukonick et al. | 340/799 X |
| 4,228,430 | 10/1980 | Iwamura et al. | 340/750 X |
| 4,414,645 | 11/1983 | Ryan et al. | 340/750 X |
| 4,415,890 | 11/1983 | Iwakura | 340/750 X |
| 4,418,344 | 11/1983 | Brown | 340/750 X |
| 4,454,593 | 6/1984 | Fleming et al. | 340/703 X |
| 4,486,856 | 12/1984 | Heckel et al. | 340/799 X |

*Primary Examiner*—Gerald L. Brigance
*Assistant Examiner*—Vincent P. Kovalick

[57] ABSTRACT

In a raster scan digital display system, a display image is stored, as coded characters or a bit map, which is larger than the display image. In order to define an image, within the stored image, for display, the addressing system for the memory (or memories) storing the image include a display image defining circuit. This circuit includes an address counter which is incremented to define successive addresses of data in a line of the displayed image, or row of characters therein. The circuit includes a first register to receive the initial address of a display image and a second register to receive a value indicating the width of the stored image. For the initial line (or character row) of a displayed image, the address counter is loaded from the first register and incremented from the initial address. For each subsequent line (or character row) the address from which the counter is incremented is the sum of the initial address of the previous line (or character row) and the value in the second register.

3 Claims, 3 Drawing Figures

CNTL.
DATA
CLK
17
8
9
10
7
11
14
19
3
16
MAP 0
MAP 1
4
12
18
13
MAP 2
5
15
MAP 3
6
1
2

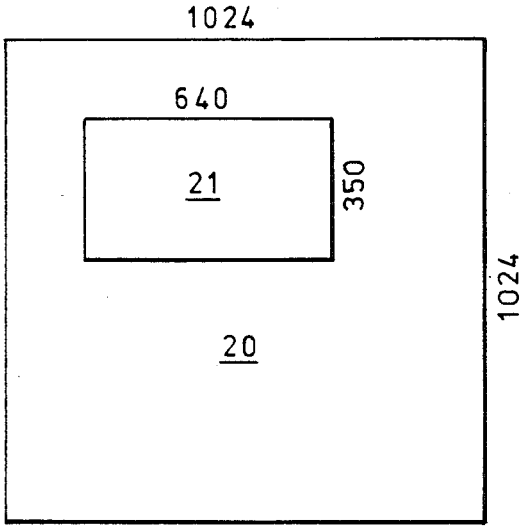
FIG. 2
FIG. 3
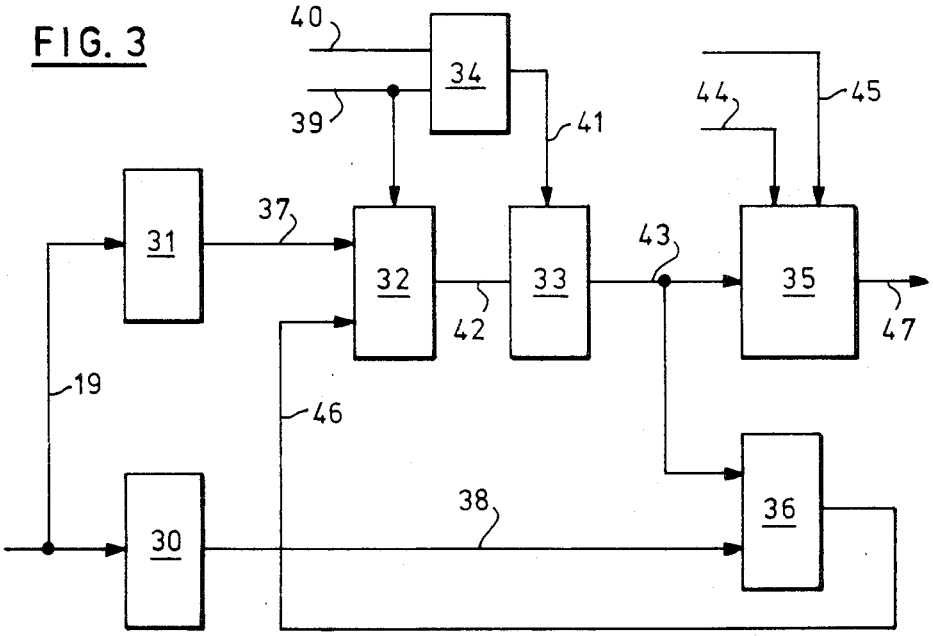

RASTER SCAN DIGITAL DISPLAY SYSTEM

DESCRIPTION

1. Technical Field

This invention relates to raster scan digital display systems, and in particular to such systems in which the actually displayed data image at any one time is a selected portion of a larger stored display data image.

2. Background Art

Raster scan digital display systems may be categorized into two general groups, bit mapped systems and character generation systems.

In the bit mapped systems, the data for display is stored as a map of the display data which, when read, sequentially produces a bit-for-displayed dot (or picture element, PEL) pattern which is displayed directly. Examples of such systems are shown in an article entitled 'Computer Graphics in Color' by P. B. Denes, Bell Laboratories Record, May 1974, pages 139 through 146, and U.S. Pat. Nos. 4,070,710 (Sukonick) 4,149,152 (Russo).

In the character generation systems, a first memory contains coded representations of characters to be displayed. These are read out in sequence and each is used to address a further memory from which the actual pel patterns are produced. This further memory is, in many cases, a read-only memory, though more flexibility can be obtained by the use of a random access memory in which alterations of the stored character sets may be effected. Examples of such systems can be found in U.S. Pat. Nos. 3,543,244 (Cuccio), 3,614,766 (Kievit), 4,068,255 (Lee), 4,177,469 (Levine) and 4,309,700 (Kraemer).

Referring again to U.S. Pat. No. 4,070,710 (Sukonick), this shows the concept of employing, in a bit mapped system, a storage map storing considerably more display data elements than those required for a displayed raster frame. The data to be displayed at any one time can be selected from the storage map as a defined area therein, and this defined area can be altered for different display frames. Thus the displayed frame of data can be 'moved' about the stored map. The arrangements for effecting this movement are, however, highly complex and involves separate control memories.

It is an object of the present invention to provide a system in which a display frame may be moved about a stored map of data, which map may be either a bit map or a character map, using a simple and inexpensive hardware arrangement.

DISCLOSURE OF THE INVENTION

The present invention relates to a raster scan digital display system in which the displayed image is derived from a stored digital image which is larger than the displayed image. A circuit is provided which accepts data indicating the initial address of the portion of the stored image to be displayed on an indication of one dimension of the stored image. From this data, the image data for a frame of the display is read automatically from the memory holding the stored image. The stored image may be in the form of a bit map or a character map.

BRIEF DESCRIPTION OF THE DRAWINGS

FIG. 2 illustrates diagramatically a stored image and a smaller display image within the stored image.

FIG. 3 is a block diagram of a circuit for selecting addresses from within the stored image of FIG. 2 in order to define the display image therein.

BRIEF MODE FOR CARRYING OUT THE INVENTION

Figure 1:
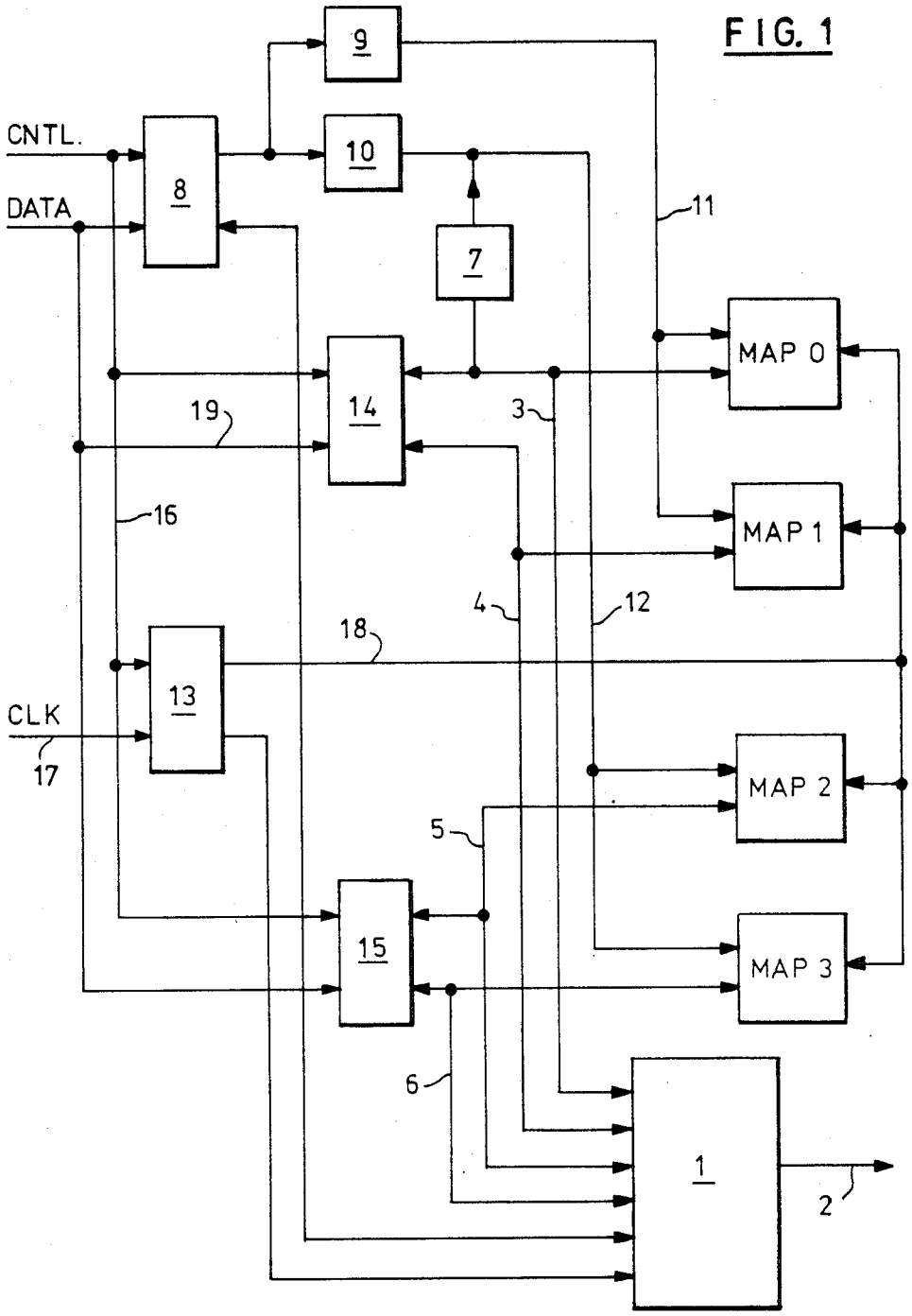
FIG. 1 is a block diagram of a raster scan digital display system.

FIG. 1 is a block diagram of a display adapter for generating a digital display on a raster scan display device, such as a C.R.T. The data to be displayed is stored in dynamic random access memories MAP0 through MAP3. For a color display device the data may be stored in bit mapped form with MAP0 storing red display data, MAP1, green display data and MAP2, blue display data. MAP3 may store attribute data or further color information. In the bit mapped mode of operation, each map data is sequence representing the sequence of dots to be displayed. On read out the maps are read in sequence, corresponding locations in each map being addressed by address system 8, 9 and 10 over busses 11 and 12 together to access the color and attribute data representing the sequentially displayed picture elements (pels). In practice, the data is read out in parallel by byte, and the bytes, each of which representing eight successive pels, are fed over memory input-/output busses 3 through 6 to a CRT drive system 1. In system 1 the bytes are serialized to form, from the inputs of MAP0 through MAP2, four streams of color data. Corresponding bits in these streams address a color palette system to provide parallel four-bit addresses to select, for each address, one of a set of sixteen color defining registers. The outputs from these registers are then combined with timing and synchronization signals to generate CRT drive signals on output lines 2. The above described arrangement is similar to that shown in an article entitled 'Computer Graphics in Color' by P. B. Denes, which appeared in the Bell Laboratories Record in May 1974 at pages 139 through 146. Reference to this article will provide a full understanding of the color palette system.

The FIG. 1 display adapter is, in addition to the bit mapped mode described above, operable in a character generator mode. In this latter mode, only MAP0, MAP1 and MAP2 are required. MAP0 now stores the sequence of representations of characters to be displayed. Each stored character representation is, in fact a partial address for MAP2. Thus, for example, the character 'A' representation, whenever it occurs in MAP0, is one partial address value, the character 'B' is another partial address value, and so on for each of the characters in a character set to be displayed. MAP1 now stores, at locations corresponding to the MAP0 character representation locations, attribute values to be applied to the displayed characters, these may, in fact, represent color values. MAP2 now stores pel defining patterns at the locations definable by the character representation data in MAP0. Note that each displayed character occupies a number of scanning lines on the display. Accordingly, the MAP0 character representation indicates only partially the required address in MAP2 as, for the first scan line of a character the pel data normally differs from the data required for the second scan line. In order to complete the addresses for MAP2, the character representations read from MAP0 are applied to a latch/multiplexer circuit 7 which receives row scan data to complete the MAP2 addresses. Thus, for the first scan line of a row of characters, each character representation from MAP0 is read in sequence and is combined with the value '0' in latch/multiplexer 7 to address MAP2 over bus 12. For the next scan line, the same addresses are again read from MAP0, but they are now combined with the value '1' to address MAP2. This operation continues until, for character using twelve scan lines, the addresses from MAP0 are finally read and combined with the value '1011'.

For each scan line portion of a character, initially MAP0 and MAP1 are addressed, and then MAP2. The data from MAP1, i.e. an 8 bit byte is applied in parallel to a further latch/multiplexer (not shown). This data actually represents two 4 bit addresses for the color palette register. The further latch/multiplexer is a 2:1 device which provides either the upper four bits or the lower four bits stored therein in response to binary control signals. These control signals are developed from the data read from MAP2. Each time MAP2 is addressed, the output data byte is serialized to form a stream of eight serial bits which switch the further latch/multiplexer to provide selectively either the upper or lower four bits of the data stored therein. Accordingly, for each character MAP1 provides two palette addresses and MAP2 provides the sequence in which these addresses are used to develop the C.R.T. output signals.

The remaining components in the FIG. 1 system are a sequencer circuit 13 and logic circuits 14 and 15. Sequencer circuit provides, in response to control data on bus 16 and clock data on line 17, control signals for the dynamic random access memories MAP0 through MAP3 over bus 18. These signals are the row address strobes, the column address strobes and the write enable signals which are required by all such memories for read, write and refresh operations. Logic circuit 14 effects data transfer between memories MAP0 and MAP1 and a data bus 19 under the control of signals on control bus 16, and logic circuit 15 effects such transfers between MAP2 and MAP3 and data bus 19. Busses 16 and 19 and clock lines 17 are, of course, coupled to a data processing system, for example a microprocessor, which generates the signals for display. Addressing system 8, 9 and 10, mentioned above, comprises a C.R.T. controller 8 and address generators 9 and 10. C.R.T. controller is responsive to control signals on bus 16 to provide memory addresses for MAP0 through MAP3 in the form of linear addresses, starting from address '0' through to address 131071 in the case of 128K memories. The address generators then convert these linear addresses to the co-ordinate addresses required by the memories. The present invention relates to the generation of the above mentioned linear addresses, and in particular to a panning arrangement in which these addresses are generated. Panning may be defined as a combination of vertical and horizontal display scrolling. The effect on the screen is the same as that effected by a movie camera as it is panned and/or tilted. There are two ways to effect vertical and horizontal display scrolling. One is to change the content of the store holding the display data between frames. The other is to store a display image which is larger than that which can be displayed at any one time. Then, by selecting the starting position for each actually displayed frame, the displayed data can be 'moved' about the stored data.

FIG. 2 illustrates the second of the above arrangements. The block 20 represents a stored display pattern of 1024×1024 bits, this, of course corresponds to a 128K byte memory. This display pattern will, for convenience, be called herein a 'logical screen'. Block 21 represents a pattern of display bits which can be displayed at one time. This comprises a matrix of 640×350 bits, which gives 80 characters or graphic bytes per line, and will, for convenience be called herein a 'physical screen'. The object is to move the physical screen about the logical screen. It should be noted that the panning operation can be applied in both modes of operation of the FIG. 1 system, that is, the bit mapped mode and the character generation mode. It should also be noted, however, that the 1024 horizontal bits in FIG. 2 are made up, in the FIG. 1 memories, of 128 bytes and each address is that of a byte of data. Consequently, in the bit mapped mode the minimum movement of the physical screen over the logical screen horizontally is eight bits, whilst the minimum vertical movement is one scanning line. In the character generation mode, in order to maintain complete characters on the display, this minimum movement in the horizontal direction, assuming characters each employing 8×12 pels, is required anyway, but arrangements must be made to ensure that the minimum vertical movement of the physical screen is, in this case, 12 bits of the logical screen, or 12 display lines. What is provided by the present invention is means for addressing all the memories in the bit map mode, or MAP0 and MAP1, in the character generation mode, such that locations corresponding to a required physical screen are read therefrom. The idea is to access the required logical screen locations in sequence automatically from a given reference location, which corresponds to the top left hand corner of the physical screen.

FIG. 3 shows the addressing system for the panning function. This sytem forms part of the C.R.T. controller 8 of FIG. 1. The system comprises a start of screen register 31 and a logical line range register 30, each coupled to data bus 19, which, as can be seen in FIG. 1, comprises the microprocessor data input/output lines. The output of register 31 is applied to a multiplexer 32 over a bus 37. Multiplexer 32 also receives the output of an adder 36 over a bus 46. Multiplexer 32 is operable to pass signals received over either bus 37 or bus 46 under the control of a C.R.T. vertical retrace signal on a line 39. The output of multiplexer 32 is fed over a bus 42 to a start of line register 33. This is controlled by signals on line 41 from an OR circuit 34 which receives the aforementioned vertical retrace signals on line 39 and 'end of row scan' signals on line 40. Bus 43 delivers signals from register 33 to an address counter 35 and to adder 36 which receives, as its other input, the output from register 30 over a bus 38. Address counter 35 is responsive to the signals on bus 43, clock signals on a line 44, and C.R.T. horizontal retrace signals on a line 45 to develop linear addresses on output bus 45. These addresses are fed to address generators 9 and 10 (FIG. 1) which, as has been described, develop the memory coordinate addresses from the linear addresses.

In order to detail the operation of the FIG. 3 system, we will first assume that the FIG. 1 system is operating in the bit mapped mode and that we are to select the physical screen 21 (FIG. 2) within the logical screen 20 for display. In the layout of FIG. 2, the logical screen width is 1024 bits, that is 128 bytes, called herein characters for convenience, and there are 1024 character lines, indicated by the height of logical screen 20. Using linear addressing, the top left hand character in the logical screen is at address 0, the character immediately underneath it is at address 128, the character underneath that is at address 256 and so on with the character at the bottom left hand corner being at address 130943. Accordingly, assuming the required physical screen starts at line 160 and at the 21st character from the left of the logical screen, the initial address of the physical screen (i.e. that at the top left hand corner) will be $159\times128+20=20372$. This is because the initial, left hand address of line 160 in the logical screen is $159\times128$ and the 21st character address is 20 character addresses to the right of this initial character address.

Referring back to FIG. 3, to display the physical screen of FIG. 2, the initial address 20372 is loaded by the microprocessor into start of screen register 31. The logical line range register 30 is similarly loaded with the number of characters in row of the logical screen, that is, 128. A vertical retrace signal on line 39 causes multiplexer 32 to pass the initial address from register 31 to the start of line register 33. A vertical retrace signal on line 39, through OR circuit 34 clocks register 33 to pass the initial address to address counter 35 and adder 36 over bus 43. Counter 35 loads the initial address on reception of the next C.R.T. horizontal retrace signal on line 45 and passes this address to the address generators 9 and 10 (FIG. 1). It is then incremented by the value 1 for each subsequent character read time for the first line of the selected physical screen by the character clock signals on line 44. Thus, as the C.R.T. is scanned, succeeding corresponding locations in MAP0 through MAP3 are addressed to generate the pel data for the first C.R.T. scan line. At the end of the first C.R.T. scan line, as there is no vertical retrace signal on line 39, multiplexer 32 passes the output of adder 36 to the start of line register 33. The adder output is the sum of the initial address and the content of the logical line range register 30. The end of row scan signal on line 40 passes through OR circuit 34 to clock register 33 with the output multiplexer 32. The output of register 33 therefore provides the initial address for the second scan line and this is loaded into the address counter 35 during the C.R.T. horizontal retrace time to provide the sequence of addresses for the second scan line. This operation is then repeated for the remaining scan lines of the physical screen. Thereafter, on reception of a vertical retrace signal on line 32, the content of the start of screen register is again passed to the address counter for the next physical screen to be displayed. Note that each vertical retrace signal is used in a non-interlaced scanning system. If interlacing is employed, then only alternate vertical retrace signals must be used.

When the FIG. 1 system is employed in the character generation mode, rather than the bit mapped mode, the FIG. 3 system is equally useful. It will be recalled that in this mode, MAP0 and MAP1 are accessed together to provide the data for the characters to be displayed and their attributes. The main difference in the addressing arrangement is that these stores have to be accessed with the same addresses twelve times for each row of characters to be displayed, assuming an $8\times12$ pel character format. This is achieved in the FIG. 3 system simply by providing an end of row scan signal on line 40 to effect loading of start of line register 33 only on the occurrence of each twelth actual C.R.T. horizontal retrace signal on line 45. This can, of course, be achieved by a counter which counts down from the selected number, in this case twelve, to provide an output when it reaches a count of zero.

Thus, what has been provided is a simple, automatic system for defining a physical display screen within a stored logical screen. The position of the physical screen is defined at the start of the scanning of the physical display screen, and can be moved anywhere on line byte boundaries within the logical screen merely by defining the start of screen address. The system may be employed in a bit mapped display system or a character generator display system. The term 'panning' as used herein is intended to cover all movements of the physical screen. Such movements include horizontal movement by a byte (or character) or vertical movement by a line (or character row height) at a time, or combinations of such movements. Successive physical screen displays may, however be spaced by any distance, provided that the successive physical screens fall within the confines of the logical screen.

Finally, while the invention has been particularly shown with reference to a preferred embodiment, it will be understood by those skilled in the art that various changes in form and detail may be made without departing from the spirit and scope of the invention.

We claim:

1. A raster scan digital display system comprising a memory for storing data for display on a raster scan display device, said memory storing a logical data image in an $m\times n$ matrix of memory locations, said logical data image being larger than a physical data image, displayable on the display device, in an $o\times p$ matrix of memory locations where m, n, o and p are integers, m is larger than o, and n is larger than p, and addressing means for addressing memory locations of an $o\times p$ matrix in sequence from a selected initial location address to retrieve a physical data image for display, said addressing means comprising:

(a) a first register for storing said initial location address, and having an output;

(b) a multiplexer having a first and a second data input, and output and a control input;

(c) a second register for storing said integer m;

(d) a third register having data input; a control input and an output;

(e) an adder having a first and a second input and an output;

(f) an address counter having a data input and a control input;

(g) means coupling the output of the first register to the first input of the multiplexer, the output of the multiplexer to the input of the third register, the output of the third register to the data input of the counter and to the first input of the adder, the output of the second register to the second input of the adder and the output of the adder to the second input of the multiplexer;

(h) means coupling vertical retrace signals from the display device to the control input of said multiplexer to switch the multiplexer from a first condition coupling the output of the adder to the multiplexer output, to a second condition coupling the output of the first register to the multiplexer output, for the duration of each vertical retrace signal;

(i) means coupling said vertical retrace signals and signals corresponding to selected horizontal retrace signals to the control input of said third register to transfer data from said third register to said counter and to the first input of said adder; and (j) means coupling clock signals to the control input of said address counter to increment the counter from each data value applied thereto from said third register to generate row addresses of said o×p matrix.

2. A raster scan digital display system according to claim 1 adapted to operate in a bit mapped mode in which data read from each location in the o×p matrix represents a picture element pattern on a displayed image, and said selected horizontal retrace signals comprises each horizontal retrace signal during scanning of a physical image to be displayed.

3. A raster scan digital display system according to claim 1 adapted to operate in a character generation mode in which data read from locations in the o×p matrix comprises character codes by which a character pattern memory is accessed, and said selected horizontal retrace signals comprise each horizontal retrace signal immediately following the scanning of a displayed row of characters on the display device.

* * * * *